US005090471A

United States Patent [19]

Wilson

[11] Patent Number: 5,090,471

[45] Date of Patent: Feb. 25, 1992

[54] CONTINUOUS CASTING

[76] Inventor: Robert Wilson, Hillside of Prieston, Tealing, Dundee, DD4 0RG, United Kingdom

[21] Appl. No.: 576,516

[22] PCT Filed: Apr. 7, 1989

[86] PCT No.: PCT/GB89/00360

§ 371 Date: Oct. 4, 1990

§ 102(e) Date: Oct. 4, 1990

[87] PCT Pub. No.: WO89/09668

PCT Pub. Date: Oct. 19, 1989

[30] Foreign Application Priority Data

Apr. 8, 1988 [GB] United Kingdom ..... 8808186

[51] Int. Cl.[5] ..... B22D 11/10

[52] U.S. Cl. ..... 164/439; 164/335

[58] Field of Search ..... 164/483, 484, 335, 337, 164/437, 439, 133, 488

[56] References Cited

U.S. PATENT DOCUMENTS 3,201,837 8/1965 Sylvester ..... 164/337

4,852,631 8/1989 Herbin et al. ..... 164/98

FOREIGN PATENT DOCUMENTS 817788 8/1951 Fed. Rep. of Germany ..... 164/439

*Primary Examiner*—Kuang Y. Lin

*Attorney, Agent, or Firm*—Krass & Young

[57] ABSTRACT

A crucible (11) for use in a continuous casting process using upwards feed induced by gas pressure within a surrounding casing (10) consists of a monolithic or one-piece crucible body (28) of refractory material defining a melt chamber (29) having a charging opening (30) at one end and a melt outlet (31) at the opposite end, the melt outlet communicating with a die feed port (35) by way of ducts (32, 34) extending through the crucible body. The melt chamber and the ducts are formed in the body by machine-boring or drilling. The melt outlet (31) also communicates with a narrowed drain port (33B) near which are cooling probe recesses (38) for receiving cooling probes (44) to effect a drain plug of "frozen" melt. The plug is cleared to drain the crucible completely simply by withdrawing the cooling probes.

12 Claims, 2 Drawing Sheets

CONTINUOUS CASTING

This invention relates to continuous casting.

The invention is especially but not exclusively concerned with pressurised upward-feed continuous casting.

The invention relates, in particular, to continuous casting apparatus, and to a method of recovering melt from such apparatus.

In continuous casting, solidified metal is drawn from a die which is continuously fed with melt. The draw can be either vertical or horizontal; and the feed can be either upwards or downwards. These possibilities are already known. Where upwards feed is required, it has hitherto been necessary by means of suction or pressure to induce melt to enter and flow in a nozzle or tube of which a lower end is immersed in the melt and the upper end is connected to feed the die. The melt is held in a crucible. With these known arrangements for upward feed, various disadvantages are experienced. For example, it is virtually impossible to induce all of the melt into the feed tube; and the remaining melt can be recovered from the crucible sometimes only with difficulty subsequent to a casting "run". Moreover, effecting lasting and leak-free connection between the feed tube and the die is difficult. Also, changing a die is not feasible without bringing the entire operation to a relatively low temperature.

An object of the present invention is to provide improvements in continuous casting apparatus and method whereby one or more of the aforesaid disadvantages is/are obviated or mitigated.

According to one aspect of the present invention, there is provided continuous casting apparatus comprising a casing, a crucible within the casing, means for sustaining a raised gas pressure within the casing so that the pressure acts in and around the crucible, and feed duct means for carrying melt from a melt chamber in the crucible to a casting die leading from the casing; characterised in that the crucible has a one-piece body of a refractory material, and the feed duct means extends through the body of the crucible from a relatively lower inlet in the melt chamber to a relatively upper outlet at a feed port formed in the body of the crucible.

According to another aspect of the present invention, there is provided a method of recovering melt from a continuous casting apparatus; wherein the apparatus comprises a crucible having a one-piece body of a refractory material with an integral drain port, and said method comprises the steps of locally cooling the vicinity of the drain port whilst producing melt in the crucible so that a plug solidifies in the drain port, and withdrawing or stopping said cooling so that heat from the melt liquifies said plug.

According to yet another aspect of the present invention, there is provided a crucible comprising a one-piece body of a refractory material, and a melt chamber in said body with a charging opening at an upper end of the chamber; characterised in that the chamber has a melt outlet from a lower end of the chamber, first duct means extends through the body from said melt outlet to a drain port, feeding duct means extends through the body from the first duct means to an upper feed port formed in said body, and the body is recessed in the vicinity of the drain port to receive or accommodate means for effecting localised cooling of said vicinity.

Embodiments of the present invention will now be described, by way of example, with reference to the accompanying drawings in which.

Figure 1:
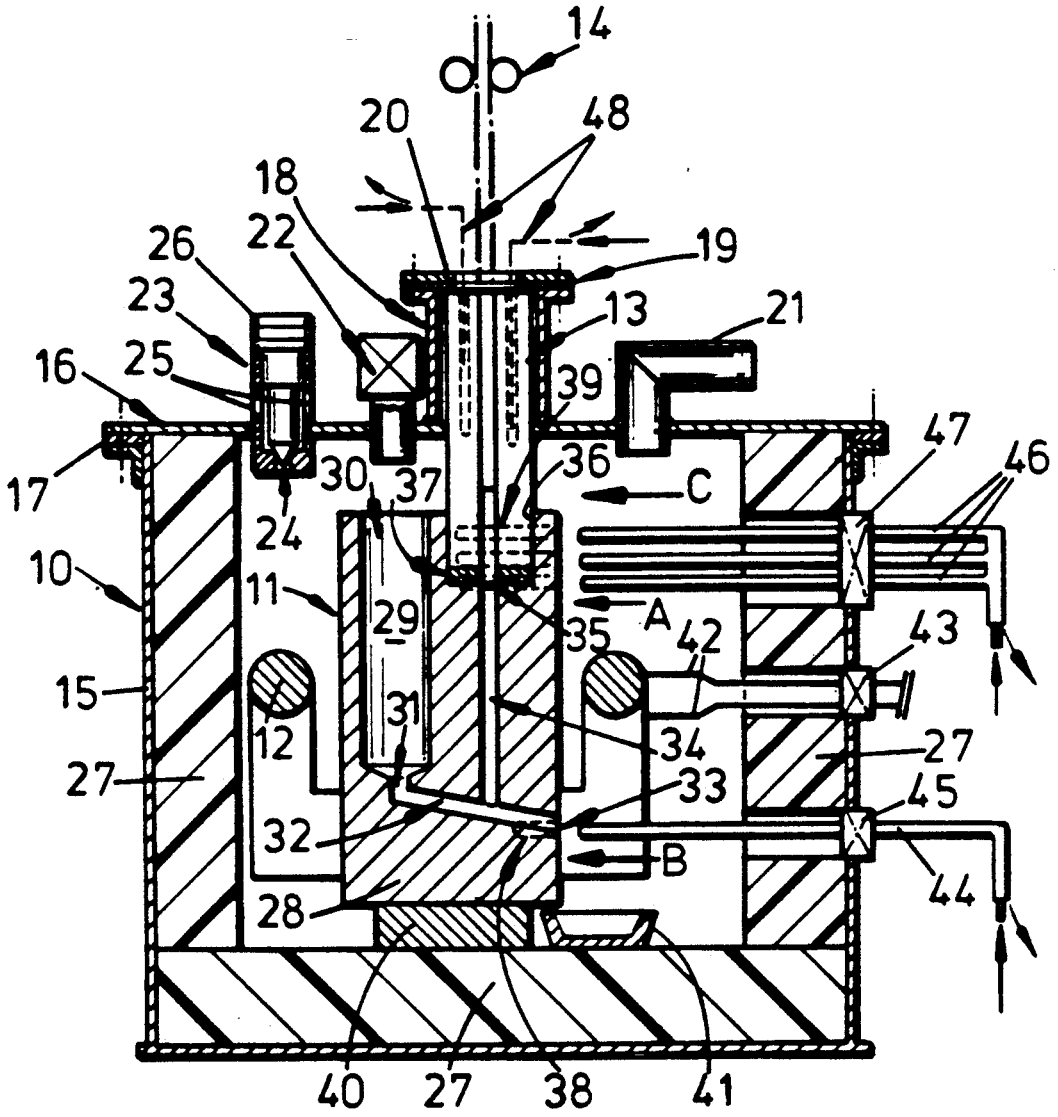
FIG. 1 is a diagrammatic sectional elevation of a continuous casting furnace incorporating a crucible in accordance with the present invention.
Figure 2:
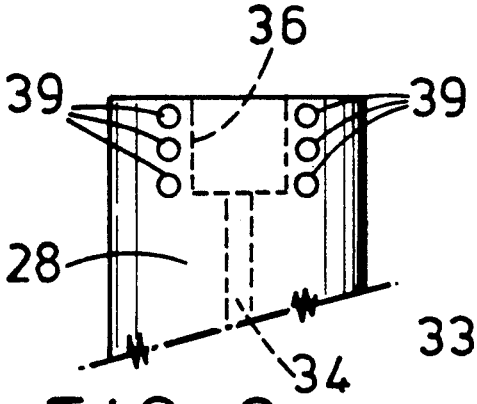
FIG. 2 is a view in the direction of arrow A in FIG. 1 of part of the crucible seen in FIG. 1.
Figure 3:
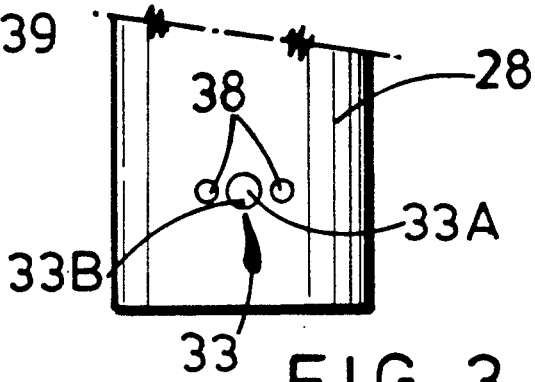
FIG. 3 is a view on arrow B in FIG. 1 of a lower part of the crucible seen in FIG. 1.

In the drawings, a continuous casting apparatus has an outer casing indicated generally by reference numeral 10, a crucible 11 within the casing 10 and capable of being brought to a working temperature by means of a heating element 12, a continuous casting die 13, and withdrawing rolls 14.

More particularly, the casing 10 consists of a generally rectangular steel shell 15 and a lid or cover 16 capable of being secured to the shell 15 in co-operation with a seal 17 by means of fixing bolts (not shown). A centre portion of the lid 16 is provided with a vertical tubular housing 18 arranged to accommodate the upper portion of the casting die 13. The top fact of the die 13 is engaged by a further seal 19 and located by an annular cover 20.

The cover 16 is fitted with a duct 21 providing a means for supplying the interior of the casing 10 with a gas under pressure. Also, the duct 21 may be used for the purpose of evacuating the interior of the casing 10. The cover 16 is also fitted with an "air-lock" charging port 22 by means of which charge metal may be introduced to the interior of the casing 10 under operating conditions. Finally, the cover 16 is fitted with a gas discharge and pressure control valve 23. The valve 23 features a needle and metering orifice at 24, discharge ports 25, and weights 26 which can be removed or added to adjust the gas discharge pressure.

The casing 10 is lined with a thermal insulating material 27.

The crucible 11 consists of a one-piece rectangular body 28 of a refractory material such as graphite. The body 28 is machined to define a melt chamber 29 having a charging opening 30 at the top end and a melt outlet 31 at the opposite lower end. A first duct means 32, drilled through the body 28, extends between the melt outlet 31 and a drain port at 33, the duct 32 following a descending path to assist draining. A second duct means 34 extends through the body 28 from an intersection with the duct 32 to a feed port at 35. The body 28 is further machined to define a cylindrical recess 36 which accommodates and supports the lower end of the casting die 13. The recess 36 is concentric with the duct 34, and leak-proof connection between the duct 34 and the casting die 13 is effected by means of a seal 37 of a flexible refractory sealing material such as GRAFOIL (trade mark).

To each side of the drain port 33, the body 28 is provided with probe recesses 38; and similar probe recesses 39 are provided in the body 28 to each side of the die recess 36. The function of these probe recesses 38, 39 is explained further herebelow. The body 28 is supported within the casing 10 on a refractory tile or block 40. A drainage collecting crucible 41 is positioned below the body 28 for receiving residue melt as explained hereunder.

Electrical connections 42 for the heating element 12 are routed to the outside of the casing 10 through a seal at 43.

In line with the probe recesses 38, the casing 10 carries two water-cooled probes 44 which extend into the casing 10 through a seal 45 operable to permit insertion and withdrawal of the probes 44 so that the probe tips can selectively be disposed within the probe recesses 38. Similarly, in line with the probe recesses 39, the housing 10 carries six further water-cooled probes 46 which extend into the housing 10 through a seal 47 operable to allow insertion and withdrawal of the probes so that the probe tips may be disposed within the probe recesses 39.

The casting die 13 is of known construction, made from a refractory material such as graphite. The die 13 is equipped in known manner with position-adjustable water-cooled probes 48 operable to ensure that the liquidus/solidus interface during casting is positioned approximately at the level indicated by arrow C in FIG. 1.

Figure 4:
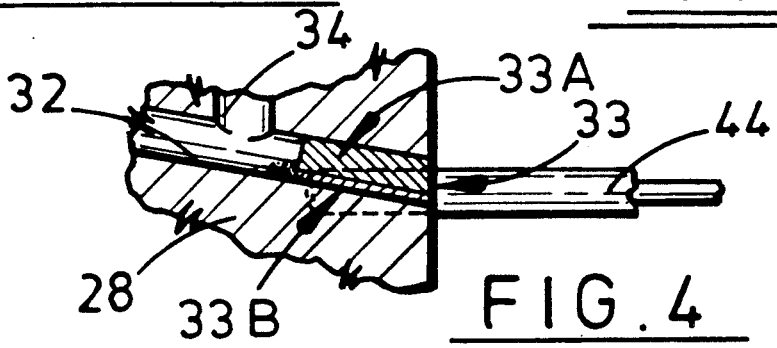
FIG. 4 is an enlarged sectional elevation of part of the crucible seen in FIG. 1.

Greater detail of the construction of the drain port 33 of FIG. 1 can be seen in FIG. 4. When the duct 32 has been drilled into the graphite body 28, a plug 33A is inserted into the duct and a smaller drain hole 33B is made through the plug 33A. Operation of the drain port is explained in greater detail hereunder.

Operation of the continuous casting furnace is as follows. When assembly of the furnace is complete, metal charge is introduced into the melt chamber 29 by means of admission through the charging port 22. The probes 46 are set to a withdrawn position, and the probes 44 are inserted so that their tips are disposed within the probe recesses 38. The heating element 12 is energised and when melt is produced it flows through the melt outlet 31, through duct 32 and into the small drain hole 33B the vicinity of which is cooled. Accordingly, a "frozen" plug of the charge metal forms in the hole 33B so blocking the drain port 33. Continued production of melt results in the liquid metal ascending within duct 34 until levels equalise in this duct and in the melt chamber 29. A starting wire is positioned within the casting die 13 in known manner. The continuous casting process is started by increasing the pressure of inert gas flowing into the casing 10 through the duct 21, the increase in pressure acting on top of the metal in melt chamber 29 being sufficient to raise the level in duct 34 to enable continuous casting.

The casting die 13 may be replaced without first allowing the entire furnace to cool and without damage to the body 28 by oxidation. Thus, prior to opening the die housing 18 the probes 46 are inserted into the probe recesses 39 thereby to cool the vicinity of the body 28 at the interface between the casting die and the feed port 35, bringing the temperature in this vicinity to about 400° C. Then, the casting die may be replaced, the probes 46 withdrawn, working temperature regained and the casting can continue.

On completion of a casting run and/or when all of the melt has been used, the probes 44 are withdrawn so that the vicinity of the drain port 33 heats sufficiently to melt the metal in the hole 33B. Thereafter, metal remaining in the body 28 drains into the collecting crucible 41. This arrangement enables maximum economy which is especially significant when costly or precious metals are being used.

Figure 5:
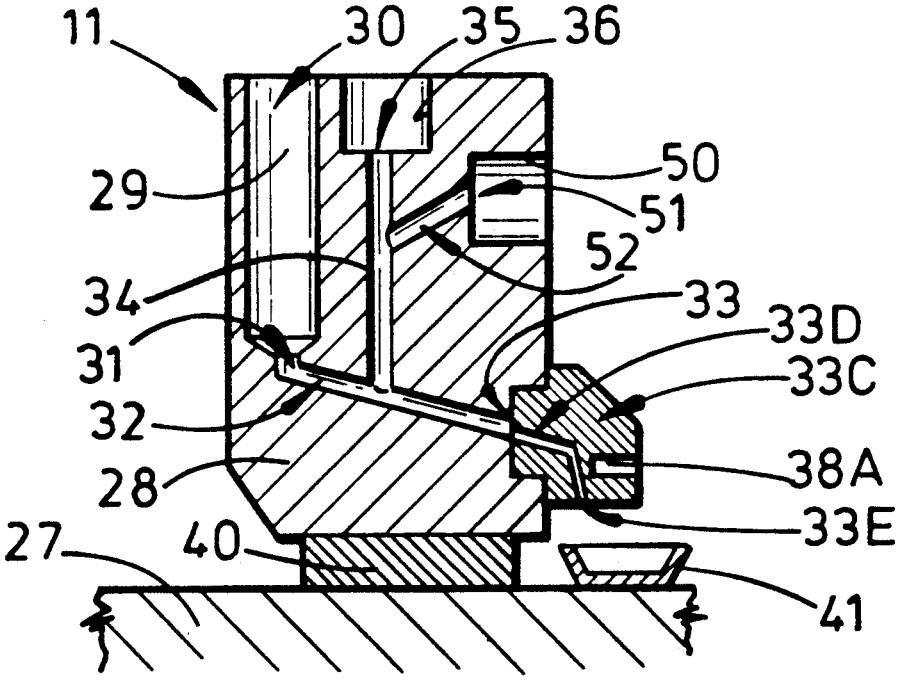
FIG. 5 is a sectional elevation of a modified crucible, similar to part of FIG. 1.

The crucible shown in FIG. 5 incorporates modifications within the scope of the present invention. In FIG. 5, features corresponding with those already described with reference to FIG. 1 are given the same reference numerals as used in FIG. 1. First, in FIG. 5, the crucible body 28 features an additional cylindrical recess 50 which is intended to accommodate a casting die (not shown) from which metal can be drawn in the horizontal mode of continuous casting. It will be understood that the shell 15 and associated equipment would be appropriately modified. The die recess 50 is supplied by means of a feed port 51 which communicates with the duct 34 by means of a short branch duct 52 which is inclined to assist drainage of molten metal therefrom. It is envisaged that both vertical and horizontal modes of continuous casting may be performed simultaneously. Alternatively, either of these modes is performed whilst the feed port or casting die of the other is closed by means of a graphite or other ceramic plug attached to a starter bar (not shown). Vertical mode continuous casting is particularly suited to the production of tubular material, whereas horizontal mode continuous casting is more appropriate for the production of long rods, etc.

FIG. 5 also incorporates a modification to the drain plug arrangements. Thus, the relatively simple inserted plug 33A of FIG. 4 is replaced by a graphite plug 33C which is larger than the plug 33A and has a significant portion of its mass disposed further away from the crucible body 28. The plug 33C features a narrower duct portion 33D which communicates with a still narrower drain hole 33E. Probe recesses 38A extend into the plug 33C on either side and in the vicinity of the drain hole 33E. The drain plug arrangement shown in FIG. 5 operates in the same manner as described above, but with reduced thermal effect on the melt in ducts 32 and 34 whilst the cooling probes are positioned within the probe recesses 38A to effect the "frozen" plug.

The crucible configurations described above may be used with metals which are aggressive to graphite by first lining the melt chamber, the ducts 32, 34 and the casting bore of the die 13 with a suitable refractory ceramic. This lining can be accomplished by using hard lining elements and/or by means of coating with a ceramic slurry.

During a casting process, the gas pressure within the casing 10 is held at a constant pressure throughout the casting cycle at a value more than sufficient to raise liquid metal in the duct 34 to the liquidus/solidus interface. Such pressure would generally be between 0.2 and 0.8 bar depending upon the liquid density of the metal or alloy being cast.

It will be noted that by means of the drain port arrangements, complete recovery of all melt can be achieved at any time. This is a particularly useful facility when working with ceramic or refractory lined crucibles.

It is envisaged that continuous casting furnaces as above described may be constructed on virtually any scale. However, dimensions typical of a prototype furnace found to work satisfactorily are as follows. The body 28, of graphite, is approximately 25 cm square as viewed in plan, and approximately 40 cm high. The melt chamber 29 is about 6 cm diameter, and each of the ducts 32, 34 is about 10 mm diameter.

In modifications of the casting process and/or apparatus described, within the scope of the present invention, the crucible body is provided with multiple melt chambers; one or more melt chambers is/are connected to feed two or more casting dies; and the drain port arrangements using the "freeze/re-melt" plugging technique are used in an otherwise conventional crucible. Also, it is envisaged that the drain port (particularly of FIG. 5) may be cooled to effect "freeze" plugging by cooling means not featuring probe recesses; for example a cooling jet of gas may be used, directed at the plug body.

I claim:

1. Continuous casting apparatus comprising a casing 10, a melt chamber (29) in a crucible (11), the crucible (11) placed within the casing (10), a charging opening (30) at an upper end of the melt chamber (29), means for sustaining a raised gas pressure within the casing (10) so that the pressure acts in and around the crucible (11), the feed duct means (32,34) for carrying melt from the melt chamber (29) to a casting die (13) leading from the casing (10); the crucible being made as a one-piece body (28) of a refractory material, and the feed duct means (32,34) extending through the body (28) of the crucible (11) from a relatively lower inlet (31) in the melt chamber (29) to a relatively upper outlet at a feed port (35) formed in the body (28) of the crucible (11).

2. Apparatus as claimed in claim 1 wherein part of said duct means (34) branches to serve multiple feed ports (35, 51).

3. Apparatus as claimed in claim 2 wherein said multiple feed ports include a feed port (35) disposed to feed melt for vertical drawing, and a feed port (51) disposed to feed melt for horizontal drawing.

4. Apparatus as claimed in claim 1 wherein part of said duct means (32) communicates with a drain port (33) for discharge of all melt from the crucible (11).

5. Apparatus as claimed in claim 1 wherein the melt chamber (29) and the duct means (32, 34, 51) are formed by machine bores or drill holes extending in said body (28).

6. Apparatus as claimed in claim 4 wherein the duct means (32) narrows or is reduced in size in the vicinity of the drain port (33).

7. Apparatus as claimed in claim 4 wherein the body (28) in the vicinity of the drain port (33) is recessed (38) to receive or accommodate means for effecting localized cooling of said vicinity.

8. Apparatus as claimed in claim 6 wherein a plug (33A, 33C) is inserted into the drain port (33), said plug defining narrowing or reduced-size ducts (33B, 33D).

9. Apparatus as claimed in claim 2 wherein the body (28) at each feed port (35, 51) defines a recess (36, 50) for receiving a continuous casting die (13), and there is provided a seal (37) in the recess (36, 50) for engagement by the die (13).

10. Apparatus as claimed in claim 9 wherein the body (28) is recessed (39) in the vicinity of the feed port (35) to receive or accommodate means for effecting localised cooling of the body (28) in the vicinity of the feed port.

11. Apparatus as claimed in claim 1, wherein the casing (10) is provided with a charging port (22) for introducing charge metal to the interior of the casing (10), and the charging opening (30) of the crucible (11) is disposed below said charging port (22).

12. A crucible comprising a one-piece body (28) of a refractory material, a melt chamber (29) in said body (28) with a charging opening (30) at an upper end of the melt chamber (29), a melt outlet (31) at a lower end of the melt chamber (29), first duct means (32) extending through the body (28) from said melt outlet (31) to a drain port (33), feeding duct (34) extending through the body (28) from the first duct means (32) to an upper feed port (35, 51) formed in said body (28), and a recess (38) formed in the body (28) in the vicinity of the drain port (33), said recess (38) serving to receive or accommodate means for effecting localized cooling of said vicinity.

* * * * *